United States Patent [19]

Roedel

[11] Patent Number: 4,466,650

[45] Date of Patent: Aug. 21, 1984

[54] GOLF BALL AND TEE HANDLING TOOL

[76] Inventor: Mark F. Roedel, 6730 Bailey, Taylor, Mich. 48180

[21] Appl. No.: 431,719

[22] Filed: Sep. 30, 1982

[51] Int. Cl.[3] ..... A63B 57/00

[52] U.S. Cl. ..... 294/19 A; 273/32 F

[58] Field of Search ..... 294/19 A, 19 R, 1 R; 273/32 A, 32 F, 32 B, 33, 162 E, 202, 203, 204, 205, 206, 207, 208, 209, 210, 211, 212

[56] References Cited

U.S. PATENT DOCUMENTS 4,013,295 3/1977 Baughman ..... 294/19 A 4,313,604 2/1982 Baxter ..... 273/32 F

*Primary Examiner*—James B. Marbert

*Attorney, Agent, or Firm*—Charles W. Chandler

[57] ABSTRACT

A combination golf ball and tee handling tool comprising an elongated hollow member, an actuating rod slideably disposed in the hollow member, means on one end of the hollow member for retaining a golf tee for insertion in the ground as the actuating rod is moved toward the tee, and jaw means on the opposite end of the hollow member for returning a golf ball in response to the movement of the actuating rod.

4 Claims, 6 Drawing Figures

GOLF BALL AND TEE HANDLING TOOL

BACKGROUND OF THE INVENTION

This invention is related to an elongated tool combining means at one end for either retrieving a golf ball and at the opposite end for inserting a tee into the ground without the user having to bend over.

Golfers are occasionally in a situation where they do not wish to bend over or are unable to reach a golf ball because of its location. They commonly use some sort of retriever usually carried on the end of a long arm so that the user does not have to bend over or can reach a relatively inaccessible location.

Other tools are available for inserting tees into the ground without the player having to stoop to push the tee into the ground. One such device is illustrated in U.S. Pat. No. 1,852,956 which issued to Czichos in 1932. An example of a remotely controlled golf ball retrieving device is illustrated in U.S. Pat. No. 2,135,232 which issued to Dawn in 1932.

SUMMARY OF THE INVENTION

The broad purpose of the present invention is to provide a novel combination tool comprising a hollow elongated tube, means on one end of the tube for supporting a tee in a position such that it may be inserted into the ground, means on the opposite end of the tube for retrieving a ball between a plurality of spring-loaded jaws, and a rod for actuating both of said means.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
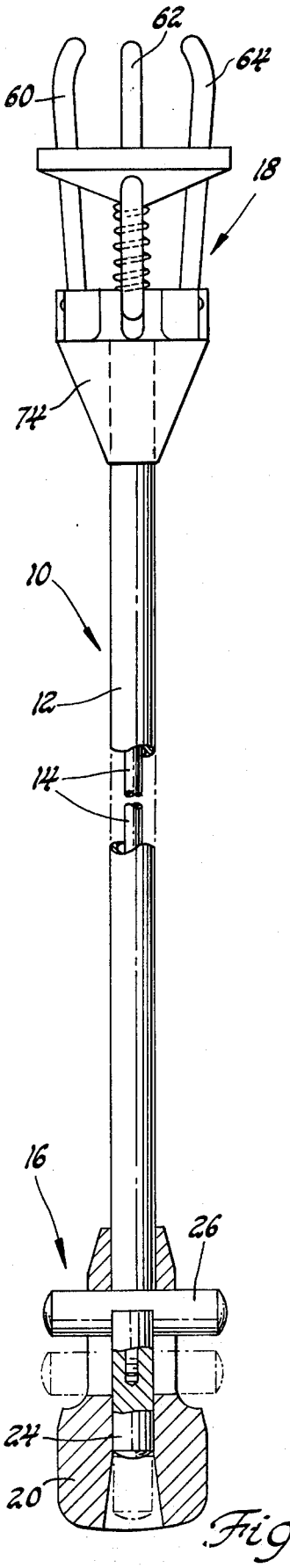
FIG. 1 is a partial sectional view illustrating the preferred embodiment of the invention.

Referring to the drawing, a preferred tool is illustrated in FIG. 1 at 10 and comprises an elongated hollow tubular member 12. An actuating rod 14 is mounted in hollow member 12. Tee inserting means 16 are mounted at one end of the tubular member 12 and ball retrieving means 18 are mounted at the opposite end. Both means are operated by longitudinal movement of the actuating rod with respect to hollow member 12.

Figure 2:
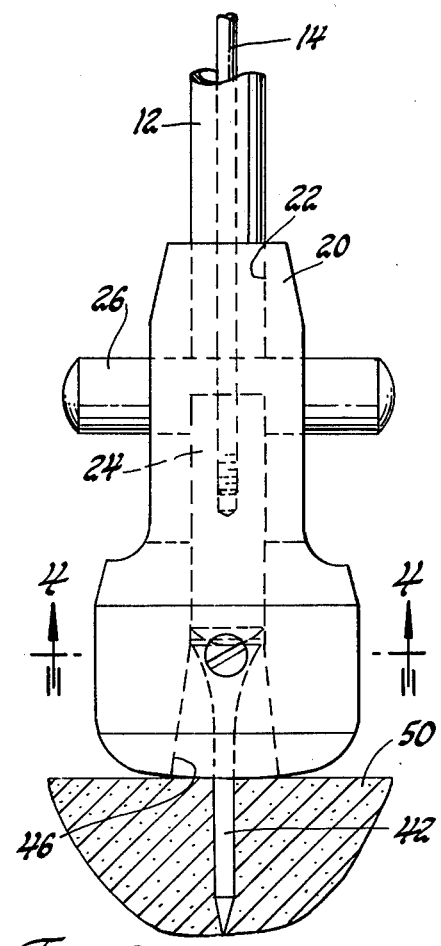
FIG. 2 is a view of the head for supporting a tee and illustrating the manner in which the tee is inserted in the ground.
Figure 4:
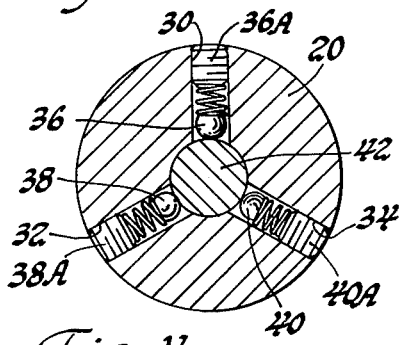
FIG. 4 is a view as seen along lines 4—4 of FIG. 2.

Referring to FIG. 2, a head 20 is mounted on the end of hollow member 12. Head 20 has an opening 22 receiving the end of tube 12.

Figure 3:
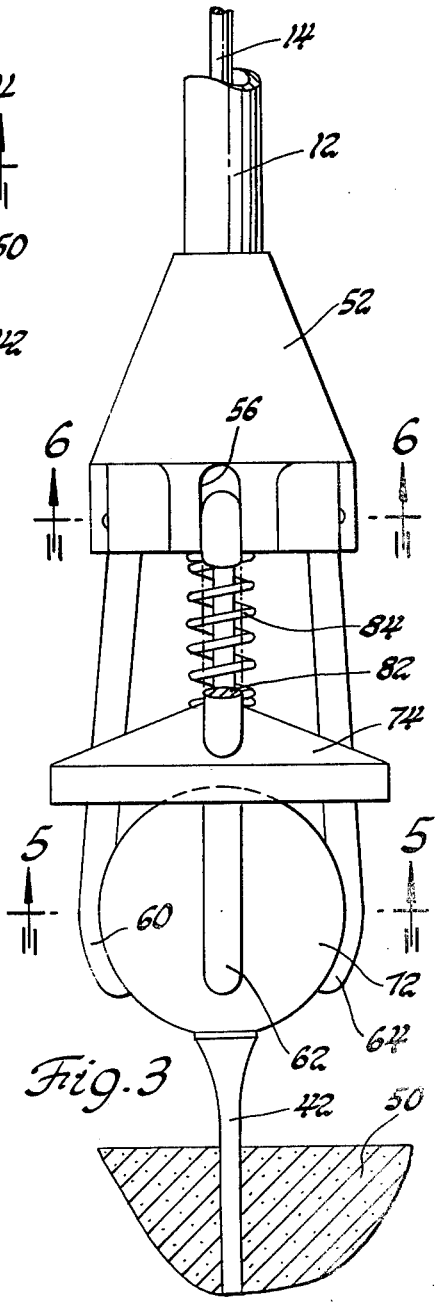
FIG. 3 is a view of the retriever end of the tool showing the manner in which a ball may be mounted on a tee.

An ejector member 24 is connected to the end of actuating rod 14. The ejector member is slideably disposed in opening 22. A handle 26 is connected to the ejector member in the rod for longitudinally moving the rod within tube 14. Referring to FIG. 3, head 20 has three equally spaced openings 30, 32, and 34 disposed around the bottom lower end of opening 22. Three spring-biased detents 36, 38 and 40 are disposed in the three openings. Threaded fasteners 36A, 38A and 40A adjust the tension of the detents. The detents are adapted to engage the neck of a conventional tee 42. Opening 22 has a diameter accommodating the head of tee 42. The lower end of the opening is flared at 46 to permit the tee to be readily inserted into the head. The arrangement is such that the user can raise the tool so that means 16 is disposed in his hands, insert a tee into the opening 46 until the head is retained in position by the three detents, and then lower the tool to press on the tee into ground 50 by manipulating the actuating rod to move ejector 24 to pass the tee beyond the three retainers so that upon raising the tool, the tee remains stuck in the ground.

Figure 6:
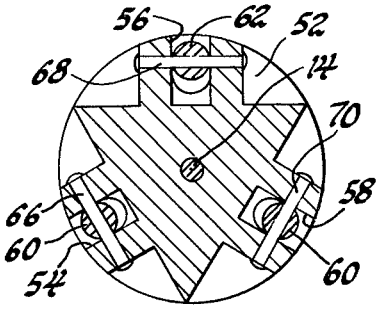
FIG. 6 is a view as seen along lines 6—6 of FIG. 3.
Figure 5:
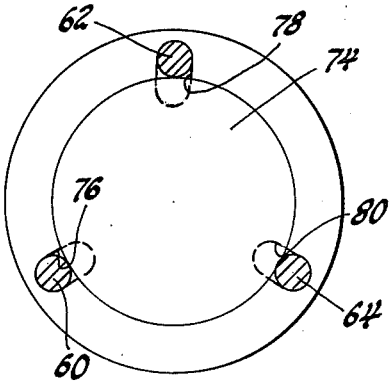
FIG. 5 is a view as seen along lines 5—5 of FIG. 3.

Referring to FIGS. 3, 5 and 6, a second head 52 is mounted on the other end of tube 12. Head 52 has three slots 54, 56 and 58. Three fingers 60, 62, and 64, each have their upper ends received in slots 54, 56 and 58, respectively. Pin means 66, 68 and 70 respectively hinge the jaws in their respective slots. The outer ends of the three jaws are curved to accommodate the curvature of a conventional golf ball 72 engaged between the jaws.

A disk-shaped ball seating member 74, as best illustrated in FIG. 5, has three slots 76, 78 and 80. The slots respectively receive the midsections of jaws 60, 62 and 64 so that the disk-shaped member is slideably movable along the jaws. The openings of slots 76, 78 and 80 are spaced from the longitudinal axis of actuating rod 14 a distance greater than the pivotally mounted ends of the jaws so that as member 74 is moved along the jaws towards the head, the lower end of the jaws is biased outwardly toward an open position for releasing the ball. When member 74 is moved toward the lower end of the jaws away from the head, the jaws move toward one another to engage the ball.

The lower end of rod 14 is attached at 82 to member 74 to move it back and forth as the user manipulates handle 26 mounted on the opposite end of the tool. A coil spring 84 is disposed around the lower end of the actuating rod to bias member 74 toward ball 72.

In use the user can remotely open or close the jaw to either retrieve the ball, or to mount a ball on a tee by moving the rod either in one direction or the other depending upon whether he wants to open or close the jaws.

Having described my invention, I claim:

1. A combination tool for handling a golf ball and a golf tee, comprising:

an elongated hollow member;

actuating rod means disposed in said hollow member for longitudinal movement thereto;

a first head mounted on a first end of the hollow member, and a second head mounted on the opposite end thereof;

the first head having an opening for receiving a tee in a position supported in the path of motion of the actuating rod means;

retainer means mounted in the first head for engaging the tee to releasably retain it in position, the tee being supported so as to be removed from the first head in response to a motion of the actuating rod means with respect to the elongated hollow member;

a plurality of jaw members mounted on the second head adjacent the actuating rod;

a guide member connected to the actuating rod and engaged with the jaw members to move them toward either a first spaced position for receiving a golf ball between them, or a second, closed position in which they engage the ball between them; and bias means urging the jaws towards said closed position.

2. A tool as defined in claim 1, in which the tee is supported on the second end such that it extends beyond the second head for insertion in the ground.

3. A tool as defined in claim 1, including handle means mounted on the second end and connected to the actuating rod for remotely moving the jaws toward said open position.

4. A tool as defined in claim 1, in which the guide member has an opening for receiving each of said jaws, the opening being disposed such that as the rod is moved in a first direction with respect to the hollow member, the jaws are moved toward said open position and as the rod moves toward the opposite position, the jaws are then moved toward the closed position.

* * * * *